United States Patent [19]

Baccaro

[11] Patent Number: 4,861,100

[45] Date of Patent: Aug. 29, 1989

[54] RECLINING ANGLE FOLDING CHAIR

[75] Inventor: Mario Baccaro, Bologna, Italy

[73] Assignee: O.M.S.I. s.a.s. di Baccaro Vincenzo & C., Italy

[21] Appl. No.: 189,199

[22] Filed: May 2, 1988

[30] Foreign Application Priority Data

Apr. 30, 1987 [IT] Italy ..... 3458 A/87

[51] Int. Cl.[4] ..... A47C 4/16

[52] U.S. Cl. ..... 297/19; 108/116; 297/29; 297/56; 297/371

[58] Field of Search ..... 297/19, 29, 56, 313, 297/320, 340, 355, 366, 370, 371, 439; 108/116, 117, 119; 248/421, 422, 423

[56] References Cited

U.S. PATENT DOCUMENTS

| | | | |
|---|---|---|---|
| 316,363 | 4/1885 | Hough | 108/116 |
| 349,627 | 9/1886 | Blackmer | 108/116 |
| 434,240 | 8/1890 | Bon | 108/116 |
| 1,324,013 | 12/1919 | Sombra | 297/19 |

FOREIGN PATENT DOCUMENTS

| | | | |
|---|---|---|---|
| 803931 | 2/1951 | Fed. Rep. of Germany . | |
| 2839391 | 3/1980 | Fed. Rep. of Germany | 297/19 |
| 3213411 | 10/1983 | Fed. Rep. of Germany . | |
| 3322788 | 1/1984 | Fed. Rep. of Germany | 297/19 |

*Primary Examiner*—Peter R. Brown

*Attorney, Agent, or Firm*—Darby & Darby

[57] ABSTRACT

A folding chair, having a seat and a backrest hinged together and supported by two pairs of crossed legs pivotably associated one with another, is adjusted by way of a device making use of a pivot, associated with the top end of one leg and rotatable about its own axis, which features an oval head with a double cam profile and a pin extending issuing from the head; the pin and the head occupy first and second tracks of substantially zig-zag profile, integral with or fitted to the chair seat, and adjustment of the reclining angle of the chair is effected by moving the pivot along the tracks from end to end through a sequence of mandatory steps that coincide with a plurality of stable positions of the pivot, each corresponding to a given angle of the backrest.

14 Claims, 2 Drawing Sheets

RECLINING ANGLE FOLDING CHAIR

BACKGROUND OF THE INVENTION

The invention relates to a device for selection and adjustment of the reclining angle of folding seats and armchairs, and similar structures.

Conventional folding chairs consist in a seat and a backrest which are hinged together and carried by two pairs of crossed legs pivotably associated one with another at each side of the seat, the front legs connecting with the uprights of the backrest; the top ends of the legs are attached to the seat in such a way as enables their movement in relation thereto.

Chairs of this kind are able to assume a number of configurations within two limit positions. In the first such limit position, the seat and backrest lie substantially at right angles to one another, whilst in the second, the chair assumes a reclining profile in which the legs are at minimum height, spread out as wide as possible with their top ends near to the edge of the seat.

The various positions are obtained by locating pins, associated with the top ends of one pair of legs, in one of a relative set of pairs of notches issuing from straight slots formed in each side of the seat.

The slots may be formed either in the rear or in the front of the seat. In either instance, the user adjusts the angle of the backrest by rotating the seat upwards; this frees the pin from the notch currently occupied and allows it to slide along the slot until engaging a further notch such as will give the desired angle.

Where the adjustment slots are located at the rear of the seat, it can happen that the occupant of the chair perches on the front edge of the seat and causes it to rotate accidentally, with the result that the pins escape from the notches currently engaged; the chair drops suddenly and at a single stroke into the reclining position, and the user's fingers can become trapped between the seat and the legs.

Similarly, with the slots located at the front, it may happen that, in gripping the front edge to the end of pulling the seat further forward, the user inadvertently rotates the seat upward, freeing the pins from the notches and producing the same result as described above.

Accordingly, the object of the invention is to overcome the drawbacks aforementioned.

SUMMARY OF THE INVENTION

The stated object is achieved with a device as disclosed. Such a device permits of adjusting the reclining angle of a folding chair by taking the component parts capable of relative movement through a number of single stable positions, each of which corresponds to a given angle of the backrest and is unobtainable except by completion of a determined sequence of steps.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 2:
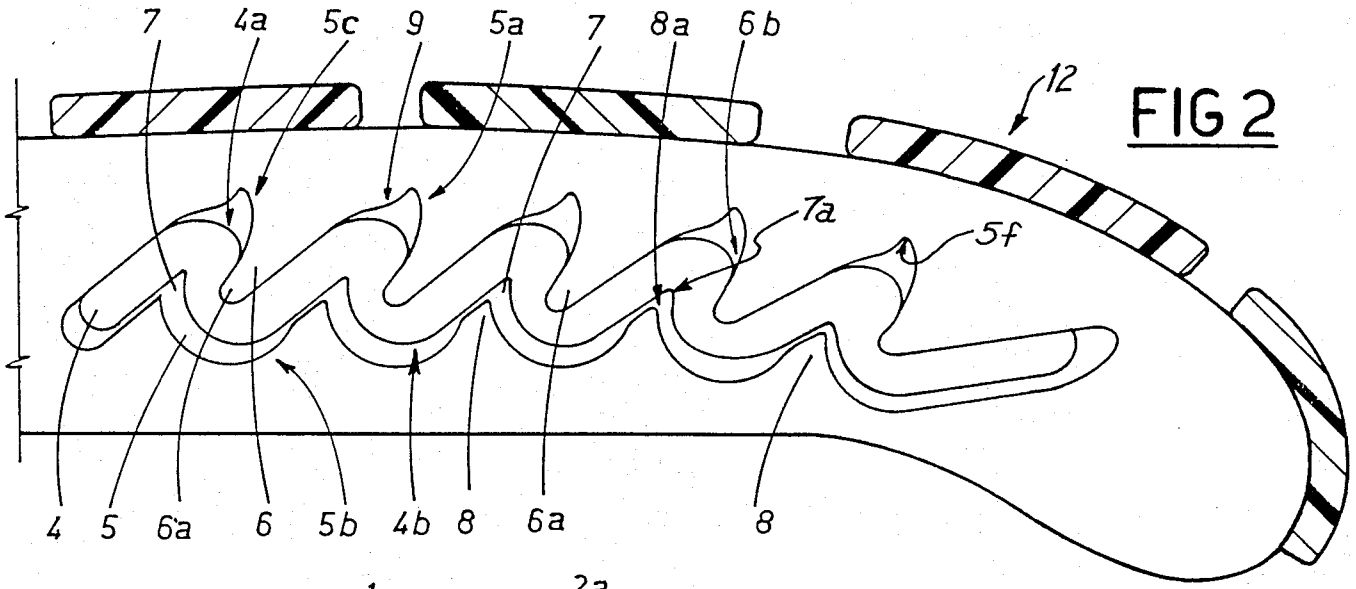
FIG. 2 shows a further component part of the device, seen in frontal elevation.
Figure 1:
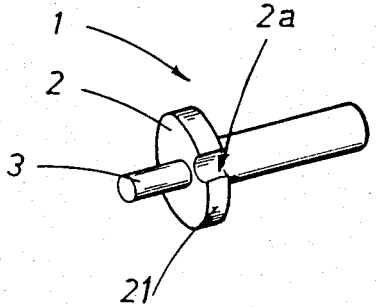
FIG. 1 shows a component part of the device according to the invention, viewed in perspective.

With reference to the drawings, the device for selection and adjustment of the reclining angle of a folding chair according to the invention consists in a pivot 1, associated with the top end of one of the legs of the chair and capable of rotating about its own axis, and a first and a second track, denoted 4 and 5 respectively, offered by or fitted to the seat of the chair; in most instances, the tracks will be pressed or moulded directly into the relative frame member of the seat.

The pivot 1 comprises a substantially elliptical oval head 2, disposed perpendicular to the axis of the pivot itself and exhibiting a double cam profile 21 created by the presence of two peripheral grooves **2*a* at points subtended by the shorter of the two axes of the ellipse, and a pin 3, which extends from the head coaxial with the axis of the pivot 1**.

The first and second tracks 4 and 5, which constitute a notched slot and are of essentially zig-zag shape, occupy two distinct parallel planes set apart one from the other in such a way as enables them to accommodate the pin 3 and the oval head 2, respectively.

More exactly, the width of the first track 4 is essentially constant and equal to the diameter of the pin 3, throughout its length; also, the top edge of the first track, denoted **4*a*, exhibits a first profile of substantially saw-tooth outline which creates a set of downwardly projecting teeth 6**.

In like manner, the bottom edge **4*b* of the first track 4 exhibits a substantially undulated second profile characterized by a set of first crests 7, the points 7*a* of which are positioned opposite to and offset from the points 6*a* of the teeth 6, and in such a way that the curve connecting two successive crests 7 appears as a circumferential arc the center of curvature of which coincides with the point 6*a* of the tooth 6** directly opposite.

The second track 5 follows a path similar to that of the first 4, its top edge **5*a* exhibiting a third profile which almost entirely mirrors that of the first profile 4*a*, except for the bend connecting each two successive teeth 6; this is extended beyond the first top edge 4*a* to create a cusp, denoted 5*c*, internally of which the oval head 2 of the pivot 1** must necessarily register.

Similarly, the bottom edge **5*b* of the second track 5 establishes a fourth profile, the outline of which is substantially identical to that of the second profile 4*b*, and exhibits a set of second crests 8; this fourth profile is set lower than the second profile to an extent whereby the distance separating the point 8*a* of a given second crest 8 from the farthest recess 5*f* of the corresponding cusp 5*c* is equal to or greater than the length of the oval head 2** of the pivot.

Figures 3, 4:
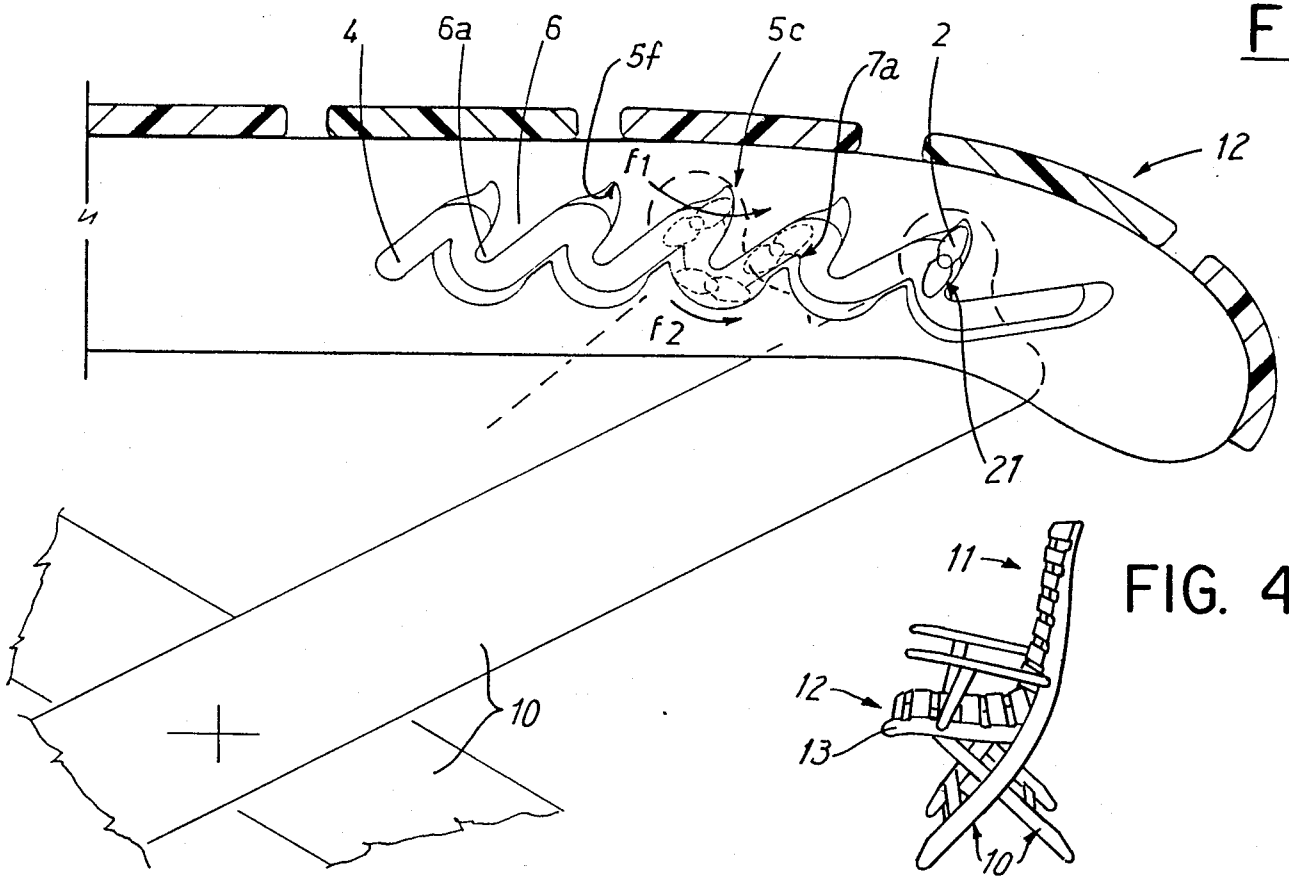
FIG. 3 shows the two components fitted together and positioned one internally of the other in different relative positions each one of which, according to the invention, corresponds to a different reclining angle.
FIG. 4 shows a perspective view of the chair in accordance with the present invention.

As illustrated in FIG. 3, the geometry described above enables the oval head 2 to effect an initial rotation, denoted f1, whereby one of its flanks 21 is brought to bear against the flank **6*b* of a given tooth 6, and thereafter to slide along the track 5 and accomplish a further rotation, denoted f2, the trajectory of which is dictated by the point 6*a* of the tooth 6**.

9 denotes a bulge forming part of the cusped profile between successive teeth 6, which is located substantially at the root of each tooth on the side opposite that of the flank *6b* aforementioned, and serves to favor the first rotation f1 accomplished by the oval head 2.

With a device thus embodied, an adjustment of the chair effected by the user causes the pivot 1 to follow the path of the two tracks 4 and 5 from end to end through a succession of mandatory steps which reflect a plurality of stable positions of the pivot itself, each one corresponding to a given reclining angle of the backrest. More exactly, to move the pivot 1 along the tracks, the user must necessarily rotate the seat upward and downward by turns in order to move the pivot 1 into each one of the succession of distinct stable positions.

FIG. 4 shows the chair of the present invention with crossed legs 10, backrest 11 and seat 12. The seat includes a frame member 13 whose inside end face corresponds to the view of the component part depicted in FIG. 2.

What is claimed:

1. A folding chair comprising a seat with a backrest which are hinged together and carried by two pairs of crossed legs pivotably connected with each other, upper ends of said legs being pivoted respectively and laterally to a back side and a front side of the seat, one of the upper ends of each of said pairs of crossed legs having a pin slidable along a notched slot located on the seat into a plurality of resting positions, the pin having a double oval head defining a double cam profile, said head having a projection extending from the head, the notched slot having a first and a second track defining a substantially zig-zag arrangement that occupies relative parallel planes set apart one from the other to accommodate the projection and the double oval head, respectively, so that adjustment of the reclining angle of the chair is effected by moving the pin along the two tracks from end to end through a succession of mandatory steps that coincide with said plurality of resting positions of the pin, each one of said resting positions corresponding to a respective reclining angle of the backrest.

2. A chair as defined in claim 1, wherein said first track defines first and second profiles, said second track defining third and fourth profiles, said first and third profiles defining a saw-tooth outline having teeth, said second and fourth profiles being substantially undulated with crests having points, said second and fourth profiles having said points opposite and offset from said teeth of said first and third profiles respectively so that a curve connecting two successive crests appears as a circumferential arc centered with respect to a point of a tooth directly opposite thereto.

3. A chair as defined in claim 2, wherein each of said profiles are shaped and formed so as to enable said double oval head to effect a first rotation so that a flank of said double oval head is brought to bear against a flank of a given tooth of said sawtooth outline and so that said double oval head thereafter slides along said tracks to effect a second rotation with a trajectory dictated by the point of the given tooth.

4. A chair defined in claim 3, wherein the first and second tracks are arranged so that the first and the second rotation accomplished by the double oval head occur in the same direction throughout passage of the pin from one end of the tracks to the other end.

5. A chair as defined in claim 2, wherein said second track has bends connecting each two successive teeth respectively of said third profile, said bends extending beyond a limit established by said first profile so as to create cusps into which said double oval head is made to locate, said fourth profile exhibiting a set of second crests that are set lower than said second profile so that a distance separating points of said second crests from topmost recesses of said cusps is at least equal to the length of the double oval head.

6. A chair as defined in claim 5 wherein said distance is sized so as to enable said double oval head to effect a first rotation so that a flank of said double oval head is brought to bear against a flank of a given tooth of said sawtooth outline and so that said double oval head thereafter slides along said tracks to effect a second rotation with a trajectory dictated by the point of the given tooth.

7. A chair as defined in claim 5, wherein each of said cusps has a bulge located substantially at a root of said teeth respectively on sides opposite of a flank of said teeth that is able to engage a flank of said double oval head so as to favor a first rotation effected by said double oval head.

8. A chair as defined in claim 1, wherein said first track is of essentially constant width equal to a diameter of the projection.

9. A chair as defined in claim 1, wherein the profile of the double cam oval head of the pin is elliptical, and exhibits two peripheral grooves subtended by the shorter of the two elliptical axes.

10. A chair as defined in claim 1, wherein the first and second tracks are separate from the seat and attached thereon.

11. A chair defined in claim 1, wherein the first and second tracks are integral with the seat.

12. A chair as defined in claim 1, wherein said resting positions are different elevations.

13. A chair as defined in claim 1, wherein said projection is coaxial with the axis of the pin.

14. A chair as defined in claim 1, wherein said double oval head extends in a plane perpendicular to the axis of the pin.

* * * * *